US005843191A

United States Patent [19]

Agostini

[11] Patent Number: 5,843,191

[45] Date of Patent: Dec. 1, 1998

[54] PROCESS FOR BLEACHING FABRICS

[75] Inventor: Andrea Agostini, Grottaferrata, Italy

[73] Assignee: Procter & Gamble, Cincinnati, Ohio

[21] Appl. No.: 952,232

[22] PCT Filed: Apr. 19, 1996

[86] PCT No.: PCT/US96/05602

§ 371 Date: Nov. 17, 1997

§ 102(e) Date: Nov. 17, 1997

[87] PCT Pub. No.: WO96/36762

PCT Pub. Date: Nov. 21, 1996

[30] Foreign Application Priority Data

May 16, 1995 [EP] European Pat. Off. ..... 95870057

[51] Int. Cl.[6] ..... D06L 3/06; D06L 3/08

[52] U.S. Cl. ..... 8/108.1; 8/107; 8/115.68; 8/115.69; 510/303; 510/307; 252/187.25; 252/187.26

[58] Field of Search ..... 8/108.1, 107, 115.68, 8/115.69; 510/303, 307; 252/187.25, 187.26

[56] References Cited

U.S. PATENT DOCUMENTS

| | | | |
|---|---|---|---|
| 2,733,120 | 1/1956 | Robson et al | 8/137 |
| 3,030,171 | 4/1962 | Lindsay | 8/109 |
| 4,120,650 | 10/1978 | Kappler et al | 8/109 |

FOREIGN PATENT DOCUMENTS

| | | |
|---|---|---|
| 743391 | 11/1966 | European Pat. Off. . |
| 2034200 | 12/1970 | France . |

*Primary Examiner*—Alan Diamond
*Attorney, Agent, or Firm*—Richard S. Echler, Sr.; Brian M. Bolam; Kim William Zerby

[57] ABSTRACT

The present invention relates to the bleaching of fabrics with a hypochlorite-containing composition. The well-known prejudice against using hypochlorite bleaches to bleach synthetic fabrics because of the resulting fabric yellowing is addressed by the presence of silicate salts in the bleaching medium.

25 Claims, No Drawings

PROCESS FOR BLEACHING FABRICS

This application is a 371 of PCT/US96/05602 filed Apr. 19, 1996.

TECHNICAL FIELD

The present invention relates to the bleaching of fabrics with a hypochlorite-containing bleaching composition.

BACKGROUND

Bleaching compositions are well known in the art. It is also known that bleaching compositions relying on hypochlorite as the bleaching agent can be preferred over oxygen bleaches, mainly for performance reasons, especially at lower temperatures.

However there are some limitations to the convenience of hypochlorite bleaches. In particular, it is well known from consumers that hypochlorite bleaching may cause yellowing of the fabrics which are being bleached. This holds particularly true for synthetic fabrics and indeed there is a standing prejudice against using hypochlorite bleaches on synthetic fibers, as evidenced by warnings on labels of commercially available hypochlorite bleaches. Also, a variety of fabrics made of or containing synthetic fibers are labeled by their manufacturers as non-bleachable.

The object of the present invention is therefore to address the issue of the yellowing of synthetic fabrics when bleached with hypochlorite bleaches.

We have found that this issue is efficiently addressed when the hypochlorite solutions used to bleach said synthetic fabrics further comprise an effective amount of an alkali metal salt of silicate. We believe that the presence of said silicate in the solution plays a role in moderating or preventing the attack of hypochlorite on brighteners which are deposited on the surface of synthetic fabrics during their manufacture and/or when treating the fabrics with laundry detergents containing brighteners, perhaps through control of metal impurities such as Cu, Fe, Ni, and Co. In the absence of silicate, we believe that it is the attack of hypochlorite on the brighteners deposited on the surface of the synthetic fabrics which causes the yellowing phenomenon. And indeed we have observed that the "yellowing prevention effect" correlates with the presence of a brightener deposited on the surface of the synthetic fabric. This invention is of high practical interest since most modern synthetic fabrics have a brightener deposited on their surface.

U.S. Pat. No. 3,056,645 and U.S. Pat. No. 3,030,171 disclose processes for bleaching fabrics which involve compositions comprising hypochlorite. Silicates are mentioned as optional ingredients, and none of these documents discuss the presence of brighteners deposited on the surface of the fabric, nor the beneficial effect of silicate as in the present invention.

U.S. Pat. No. 4,120,650 discloses a process of bleaching fabrics with a solution comprising an anionic and a nonionic surfactant, a chlorine bleach and an oxygen bleach in controlled conditions. Silicates are mentioned as optional ingredients, and the method is said to be applicable to synthetics. The presence of brighteners on fabrics is not discussed.

U.S. Pat. No. 2,733,120 discloses a process of bleaching fabrics with hypochlorite in the presence of soap. Silicate is mentioned as an optional ingredient, and '120 does not discuss synthetic fabrics and yellowing.

U.S. Pat. No. 1,931,245 discloses a composition comprising hypochlorite and silicate and its application to bleach viscose threads. The silicate is said to protect the aluminium carrier used in the process against corrosion.

EP 351,947 discloses a composition comprising hypochlorite and a brightener selected for its stability in the composition. Silicates are mentioned as optional ingredients.

Finally, co-pending European applications 93203153, 93870070.7, 94202716 and 94870103 disclose compositions comprising hypochlorite and silicate, but do not discuss their possible use on synthetic fabrics having a brightener deposited on their surface.

SUMMARY OF THE INVENTION

Accordingly, the present invention is a process of bleaching a synthetic fabric having a brightener deposited onto its surface, wherein said fabric is contacted with an aqueous solution of a bleaching amount of an alkali metal hypochlorite and an effective amount of an alkali metal salt of silicate, whereby the yellowing of said fabric is reduced or prevented.

DETAILED DESCRIPTION

The present invention is a process of bleaching synthetic fabrics which have a brightener deposited on their surface, hereinafter referred to as "the fabrics".

Fabrics can be separated into natural fabrics, i.e. fabrics made of cotton, viscose, linen, silk and wool, and all others which are synthetic fabrics. There are many synthetic fabrics available, all of which are made of polymeric fibers of synthetic origin. Mostly used are polyamide, polyester, Lycra® and Elasthane®. As used herein, synthetic fabrics also include fabrics which comprise both natural and synthetic fibers.

But such fabrics, because they do not have an ideal whiteness, are treated with an optical fluorescent brightener during their manufacture, so that said brightener is deposited, preferably absorbed onto the surface of said fabrics. That layer of brightener is to some extent at least partially renewed in subsequent washes, when the fabrics are washed with a detergent containing an optical brightener, that is to say the vast majority of detergents. Optical fluorescent brighteners are well known in the art, and can be described as compounds which have conjugated double bonds and/or an aromatic structure which enable them to absorb UV light and fluoresce. Most of the brighteners known to date belong to the class of stilbenes, and such compounds have been extensively described in the prior art.

In the process according to the present invention, the fabrics are contacted with an aqueous bleaching solution which comprises two essential ingredients other than water, i.e. an alkali metal hypochlorite and an alkali metal salt of silicate.

Such a bleaching solution is typically formed by diluting an appropriate amount of a bleaching composition into an appropriate amount of water. The bleaching composition used to generate the bleaching solution can be a dry, i.e. powdery or granular composition, or a liquid composition. Liquid compositions are widely preferred over granular compositions mainly for ease of manufacture, purity and cost reasons.

When making a liquid composition to be used in the process according to the present invention, various forms of alkali metal hypochlorites can be used which are commercially available, or mixtures thereof. The nature of the counterion for the hypochlorite is not critical herein, and sodium hypochlorite is generally used in this field because it is commercially available in large quantities and economically advantageous. The bleaching solutions herein should comprise from 0.001% to 1% by weight, based on active chlorine, of hypochlorite, preferably 0.0015% to 0.6%, most preferably 0.002% to 0.5%.

The second essential element of the bleaching solutions used in the process according to the present invention is an alkali metal salt of silicate, or mixtures thereof. Again, the nature of the counterion of the silicate is not critical, but sodium silicate is the most commonly used silicate in this field because it is economically advantageous. The bleaching solutions used in the process herein should comprise an effective amount of silicate. By effective amount, it is meant herein an amount which is sufficient to substantially reduce yellowing of the fabric, as compared to the same composition without silicate. When determining the amount of silicate to be used, one should consider that the more silicate, the greater the non-yellowing benefit. But after a certain point, the silicate precipitates. Also, for a given amount of silicate, the magnitude of the non-yellowing benefit will decrease as the water hardness and the content of heavy metal ions in the washing solution increases. But in all conditions, one will obtain the non-yellowing benefit when using silicate in the bleaching compositions. Accordingly, the bleaching solutions herein comprise from 0.0015% to 0.5% by weight, preferably from 0.002% to 0.25%, most preferably from 0.0025% to 0.15% of said alkali metal salt of silicate or mixtures thereof. Preferred bleaching solutions herein have a pH of from 8 to 14, preferably 8.5 to 13, and most preferably 9 to 12. Furthermore, preferred solutions herein comprise from 0% to 1.0%, preferably 0.005% to 0.5%, most preferably from 0.01% to 0.25% of a chelant and/or builder system, or mixtures thereof. Indeed, we have found that each of these preferred features alone or in combination do have an effect on the non-yellowing benefit. Indeed, a lower pH favors oxydative attack on the brightener, so that a higher pH, within the limits above is preferable. Suitable means for adjusting pH include strong sources of alkalinity, such as sodium hydroxide, in amounts of from 0% to 5%, preferably from 0.0002% to 0.15%, most preferably from 0.0005% to 0.1%.

Turning now to chelants, heavy metal ions in the water favor radicalic attack of the brightener, so that chelants for said heavy metal ions can be desirable as well. In this embodiment, the process of the present invention is not limited to any particular builder or chelant, and any of the builders or chelants well known in the art can be used herein. This aspect, and particularly efficient chelants have been discussed in co-pending EP 93203153.

The compositions to be used herein can further comprise, as an optional but preferred ingredient, a buffering system which helps maintaining the pH of the bleaching solution within the limits specified above, even under dilution. Indeed, maintaining an appropriate pH is important, amongst others, so as to minimize the formation of hypochlorous acid, which we have found to be responsible to damage to the fabrics being bleached.

In the process according to the present invention, a bleaching solution is formed by diluting a bleaching composition in an appropriate amount of water so as to reach the concentration of hypochlorite and silicate defined herein above. Generally, it is convenient to start from a bleaching compositions comprising from 2% to 10% by weight of the composition of hypochlorite, based on active chlorine, preferably 3% to 6%, most preferably 4% to 5%, and from 0.02% to 5% by weight of the total composition of silicate, preferably 0.1% to 2%, most preferably 0.2% to 1.6%, and to dissolve such a composition in water, with a dilution of from 0.5 g./l to 100 g./l, preferably 1.0 g./l to 50 g./l, most preferably 5.0 g./l to 25.0 g./l The fabrics to be bleached are then contacted with the bleaching solution. The period of time sufficient to enable bleaching depends essentially on the level of soil, but is generally comprised between 1 min. and 24 hours, preferably 3 min. to 1hr., most preferably 5 min. to 30 min. Afterwards, the bleaching solution can be dispensed with and the fabrics are rinsed with water to eliminate the remainder of bleaching solution. The bleaching process described herein can be performed before or after cleaning the fabrics with a detergent. Also, the bleaching step can be performed concurrently with the cleaning step by adding to the bleaching solution an appropriate amount of detergent.

The temperature of the bleaching process does have an influence on bleaching and yellowing. More specifically, an increased temperature accelerates the bleaching process, i.e. diminishes the time required to bleach a given soil, but it also increases the yellowing phenomenon. But at any given temperature, the non-yellowing benefit of silicate is obtained.

The yellowing-prevention effect of the present invention can be evaluated by comparing a composition according to the present invention to the same composition without silicate. The degree of yellowing can be determined by both visual and instrumental grading. Visually, the difference in yellowing between items treated with different compositions can be determined by a team of expert panelists. Instrumentally the assessment can be determined with the help of Colorimeters such as Ganz Griesser® instruments (e.g., Datacolor® Spectraflash® SF 500, Machbet White-eye® 500) or a ZEISS ELREPHO® or others which are available for instance from Hunterlab® or Gardner®.

EXAMPLES

1—Experimental

The test results hereinbelow were obtained with the following test protocol. 8.5 ml of each composition was diluted in 1000 ml of water so as to form a homogeneous bleaching medium. The synthetic fabrics used in this experiment were female panties type 'Rosalinda'® from Viguesa De Lengeria S. A., which is constituted of about 80% polyamide and 20% Lycra®, treated with a brightener. The fabrics are immersed in said medium for a period of 30 min. Said fabrics were then removed and rinsed. Fabric non-yellowing was evaluated by a panel of 3 expert judges on 3 replicates rating the samples according to a scale where:

| | |
|---|---|
| 0 | there is no difference between samples |
| 1 | I think there is a small difference |
| 3 | I am sure there is a difference |
| 4 | There is a big difference |

A positive value indicates that the sample is less yellow than the reference. The samples were also evaluated instrumentally with a Ganz Griesser® instrument (Datacolor Spectraflash® SF 500).

The following compositions were tested as described herebefore.

| Ingredients (% w/w) | Composition 1 | Composition 2 |
|---|---|---|
| AvCl2 | 4.95 | 5.10 |
| Sodium carbonate | 1.25 | 0.30 |
| Caustic soda | 1.40 | 0.45 |
| Sodium silicate | 0.5 | — |
| Water and minors | up to 100% | up to 100% |

The results of the assessment of the yellowing of fabrics were as follows:

| Difference between composition 1 and composition 2 | |
|---|---|
| Visual assessment (Panel Score Units) | Instrumental (Δb) |
| +4.0s | +6.9s |

s= statistically significant difference
+= composition 1 is better than composition 2

2—Further Examples

The following compositions were also made by mixing the listed ingredients in the listed proportions.

| Ingredients (% w/w) | |
|---|---|
| | Composition 3 |
| AvCl2 | 4.95 |
| Sodium carbonate | 1.25 |
| Caustic soda | 1.0 |
| Sodium silicate | 0.5 |
| Water and minors | up to 100% |
| | Composition 4 |
| AvCl2 | 4.95 |
| Sodium carbonate | 1.25 |
| Caustic soda | 0.5 |
| Sodium silicate | 0.5 |
| Water and minors | up to 100% |
| | Composition 5 |
| AvCl2 | 4.95 |
| Sodium carbonate | 1.25 |
| Caustic soda | 0.25 |
| Sodium silicate | 0.5 |
| Water and minors | up to 100% |
| | Composition 6 |
| AvCl2 | 4.95 |
| Sodium carbonate | 1.25 |
| Caustic soda | 1.4 |
| Sodium silicate | 1.0 |
| Water and minors | up to 100% |
| | Composition 7 |
| AvCl2 | 4.95 |
| Sodium carbonate | 1.25 |
| Caustic soda | 2.0 |
| Sodium silicate | 0.25 |
| Water and minors | Up to 100% |
| | Composition 8 |
| AvCl2 | 2.0 |
| Sodium carbonate | 1.25 |
| Caustic soda | 1.4 |
| Sodium silicate | 1.0 |
| Water and minors | Up to 100% |
| | Composition 9 |

-continued

| Ingredients (% w/w) | |
|---|---|
| AvCl2 | 2.0 |
| Sodium carbonate | 1.25 |
| Caustic soda | 1.4 |
| Sodium silicate | 0.5 |
| Water and minors | Up to 100% |
| | Composition 10 |
| AvCl2 | 2.0 |
| Sodium carbonate | 1.25 |
| Caustic soda | 1.4 |
| Sodium silicate | 0.25 |
| Water and minors | Up to 100% |
| | Composition 11 |
| AvCl2 | 2.0 |
| Sodium carbonate | 0.5 |
| Caustic soda | 0.25 |
| Sodium silicate | 0.5 |
| Water and minors | Up to 100% |
| | Composition 12 |
| AvCl2 | 7.0 |
| Sodium carbonate | 0.25 |
| Caustic soda | 0.00 |
| Sodium silicate | 0.5 |
| Water and minors | Up to 100% |
| | Composition 13 |
| AvCl2 | 7.0 |
| Sodium carbonate | 0.25 |
| Caustic soda | 1.0 |
| Sodium silicate | 0.5 |
| Water and minors | Up to 100% |
| | Composition 14 |
| AvCl2 | 7.0 |
| Sodium carbonate | 0.25 |
| Caustic soda | 1.0 |
| Sodium silicate | 1.0 |
| Water and minors | Up to 100% |
| | Composition 15 |
| AvCl2 | 7.0 |
| Sodium carbonate | 1.25 |
| Caustic soda | 5.0 |
| Sodium silicate | 1.0 |
| Water and minors | Up to 100% |

I claim:

1. A process for bleaching a synthetic fabric having a brightener deposited onto its surface, wherein said fabric is contacted with an aqueous solution of a bleaching amount of an alkali metal hypochlorite, or mixtures thereof, and from 0.0015% to 0.5% by weight, of an alkali metal salt of silicate, or mixtures thereof, whereby the yellowing of said fabric is reduced as compared to the same solution without silicate or prevented.

2. A process according to claim 1 wherein said solution comprises from 0.002% to 0.25% by weight of said alkali metal salt of silicate or mixtures thereof.

3. A process according to claim 2 wherein said solution comprises from 0.0025% to 0.15% by weight of said alkali metal salt of silicate or mixtures thereof.

4. A process according to claim 1 wherein said solution comprises from 0.001% to 1% by weight of said alkali metal hypochlorite.

5. A process according to claim 4 wherein said solution comprises from 0.0015% to 0.6% by weight of said alkali metal hypochlorite.

6. A process according to claim 5 wherein said solution comprises from 0.002% to 0.5% by weight of said alkali metal hypochlorite.

7. A process according to claim 1 wherein said solution has a pH of from 8 to 14.

8. A process according to claim 7 wherein said solution has a pH of from 8.5 to 13.

9. A process according to claim 8 wherein said solution has a pH of from 9 to 12.

10. A process according to claim 1 wherein said solution further comprises from 0% to 1.0% of an alkali metal salt of carbonate.

11. A process according to claim 10 wherein said solution further comprises from 0.005% to 0.5% of an alkali metal salt of carbonate.

12. A process according to claim 11 wherein said solution further comprises from 0.01% to 0.25% of an alkali metal, salt of carbonate.

13. A process according to claim 1 wherein said solution is formed by diluting in water a bleaching composition comprising from 2% to 10% by weight of an alkali metal hypochlorite, or mixtures thereof.

14. A process according to claim 13 wherein said solution is formed by diluting in water a bleaching composition comprising from 0.02% to 5%, of an alkali metal salt of silicate, or mixtures thereof, with a dilution factor of 0.5g/l to 100 g/l.

15. A process according to claim 14 wherein said solution is formed by diluting in water a bleaching composition comprising from 0.1% to 2%, of an alkali metal salt of silicate, or mixtures thereof, with a dilution factor of 0.5g/l to 100 g/l.

16. A process according to claim 15 wherein said solution is formed by diluting in water a bleaching composition comprising from 0.2% to 1.6%, of an alkali metal salt of silicate, or mixtures thereof, with a dilution factor of 0.5g/l to 100 g/l.

17. A process according to claim 16 wherein said solution is formed by diluting in water a bleaching composition comprising from 4% to 5% by weight of an alkali metal hypochlorite, or mixture thereof, and from 0.02% to 5% of an alkali metal salt of silicate, or mixtures thereof, with a dilution factor of 0.5 g/l to 100 g/l.

18. A process according to claim 17 wherein said solution is formed by diluting in water a bleaching composition comprising from 4% to 5% by weight of an alkali metal hypochlorite, or mixtures thereof, and from 0.1% to 2% of an alkali metal salt of silicate, or mixtures thereof, with a dilution factor of 0.5 g/l to 100 g/l.

19. A process according to claim 18 wherein said solution is formed by diluting in water a bleaching composition comprising from 4% to 5% by weight of an alkali metal hypochlorite, or mixtures thereof, and from 0.2% to 1.6% of an alkali metal salt of silicate, or mixtures thereof, with a dilution factor of 0.5 g/l to 100 g/l.

20. A process according to claim 1, wherein said fabric is contacted with said aqueous solution for a period of time ranging from 1 min. to 24 hrs.

21. A process according to claim 20, wherein said fabric is contacted with said aqueous solution for a period of time ranging from 3 min. to 1 hr.

22. A process according to claim 21, wherein said fabric is contacted with said aqueous solution for a period of time ranging from 5 min. to 30 min.

23. A process according to claim 1 wherein said aqueous solution has a temperature of from 4° C. to 60° C.

24. A process according to claim 23 wherein said aqueous solution has a temperature of from 10° C. to 50° C.

25. A process according to claim 24 wherein said aqueous solution has a temperature of from 20° C. to 40° C.

* * * * *